US006032662A

United States Patent [19]

Taplan et al.

[11] Patent Number: 6,032,662

[45] Date of Patent: Mar. 7, 2000

[54] COOKTOP APPARATUS

[75] Inventors: Martin Taplan, Rheinböllen; Christoph Köster, Budenheim; Marx Boris, Oberwiesen; Eva Haase, Frankfurt, all of Germany

[73] Assignee: Schott Glas, Mainz, Germany

[21] Appl. No.: 09/158,111

[22] Filed: Sep. 22, 1998

[30] Foreign Application Priority Data

Sep. 27, 1997 [DE] Germany ..... 197 42 792

[51] Int. Cl.[7] ..... F24C 3/00

[52] U.S. Cl. ..... 126/39 R; 126/214 R; 126/39 H

[58] Field of Search ..... 126/39 R, 39 H, 126/39 N, 39 J, 39 K

[56] References Cited

U.S. PATENT DOCUMENTS

| | | | |
|---|---|---|---|
| 4,971,024 | 11/1990 | Albon et al. . | |
| 5,046,477 | 9/1991 | Bennett et al. . | |
| 5,266,026 | 11/1993 | Riehl . | |
| 5,313,929 | 5/1994 | Turk et al. | 126/39 H |
| 5,623,917 | 4/1997 | Dinaso et al. . | |
| 5,653,219 | 8/1997 | Taplan et al. | 126/39 H |

FOREIGN PATENT DOCUMENTS

| | | |
|---|---|---|
| 0 536 619 | 4/1993 | European Pat. Off. . |
| 41 33 409 | 4/1993 | Germany . |
| 44 42 572 | 9/1995 | Germany . |
| 195 05 469 | 2/1996 | Germany . |
| 196 33 141 | 10/1997 | Germany . |
| 297 02 649 | 7/1998 | Germany . |

*Primary Examiner*—Carroll Dority
*Attorney, Agent, or Firm*—Walter Ottesen

[57] ABSTRACT

The invention is directed to cooktop apparatus wherein a cooktop panel is seated in a frame and is made of glass ceramic, glass or ceramic. The cooktop panel has a cutout for accommodating an atmospheric gas burner in the cooktop panel. A component assembly holds the gas burner in the cooktop panel and the component assembly includes a collar annularly overlapping a portion of the panel in the region of the cutout. The collar has an inner region defining an edge which, in turn, defines a first abutment for engaging the gas burner. A resilient metal element is attached to the gas burner and extends outwardly from the gas burner to engage the panel on the lower side thereof. The lower side of the panel defines a second abutment against which the resilient metal element applies a force F to hold the gas burner on the panel via the collar and the resilient metal element. A seal is sandwiched and clamped between the collar and the panel thereby preventing any spillage from reaching the frame through the cutout.

21 Claims, 6 Drawing Sheets

COOKTOP APPARATUS

FIELD OF THE INVENTION

The invention relates to an arrangement of an atmospheric gas burner in a cooktop apparatus having a frame and a plate or panel made of glass ceramic, glass or ceramic defining a cooking area. At least one opening is formed in the cooking area for accommodating at least one burner.

BACKGROUND OF THE INVENTION

Gas cooking areas defined by a plate-shaped body made of glass ceramic, glass or ceramic defining the cooktop panel are available in two versions in the marketplace irrespective of whether the plate-shaped body is part of a cooktop or part of a gas range. In one of the two versions, gas radiating burners are provided below a continuous cooking area wherein the gas, which is supplied together with air, is combusted at the surface of a burner plate made of porous ceramic. In the second version, atmospheric gas burners are integrated into respective openings of the cooktop panel. These are burners having an open flame and it is this second version to which the invention relates.

These cooktop panels impose special requirements on the connection between the cooktop panel and the gas burner to be integrated therein. A rigid connection of the cooktop panel or glass plate and the gas burner or a fixedly mounted gas burner is not practical because, in the case of a blow to the gas burner, a lever force is applied to the cooktop panel defining the cooking surface. If this lever force exceeds the maximum loadability of the material of the cooktop panel, then this can lead to fracturing thereof. For this reason, cooktop apparatus of this kind impose high requirements on the construction thereof. The connection of the gas burner to the cooktop panel made of glass ceramic, glass or ceramic must be so configured that the special material characteristics of the glass ceramic, glass or ceramic are considered.

For this reason, it is necessary to mechanically decouple the cooktop panel from the cooktop apparatus and from the gas burner.

On the other hand, it must be ensured that no spillage or cleaning materials reach the interior of the gas cooktop apparatus. It is therefore necessary to provide a liquid-impenetrable connection between cooktop panel and gas burner.

A whole series of solutions for integrating the gas burner into the cooktop panel are known from the state of the art.

German Patent 4,442,572 discloses a gas cooking field having a plate-shaped body made of brittle material which can fracture. In this plate-shaped body, an opening is formed for accommodating at least one atmospheric gas burner which is held in place by a metal collar in spaced relationship to the panel. The metal collar engages the panel in the peripheral region of the opening with sealing means disposed therebetween and overlapping at both sides. The collar defines an abutment for the gas burner mounted in the clear opening of the collar.

This known integration of the gas burners in the cooktop panel ensures that no mechanically rigid connection results between the cook plate and the gas burner whereby the energy, which occurs with a mechanical load on the cook plate, can be absorbed without a fracture. Furthermore, this known connecting technique also ensures that no spillage or other liquids reach the interior space of the cooktop apparatus. However, German Patent 4,442,572 makes no further suggestions with respect to the arrangement of the gas burner itself.

U.S. Pat. No. 5,046,477 discloses an improved seal of the gas burner with respect to the glass panel in that the opening of the glass panel is only so large that it can accommodate the gas burner. To provide a seal, the gas burner is fixedly connected with its peripheral edge to the glass panel. Furthermore, the gas burner is mounted on a mounting bracket connected to the carrier frame accommodating the glass panel. A mechanically rigid connection between a form body (a panel made of glass ceramic, glass or ceramic), a carrier frame and the gas burner leads, however, to the formation of stresses in the panel when the latter is mechanically or thermally loaded. In each case, the risk of fracture of the cook plate is significantly increased thereby.

German published patent application 4,133,409 discloses a burner arrangement, such as for a cooktop, wherein at least one gas burner is mounted in a carrier frame. The peripheral surface of the gas burner is covered with a plate-shaped body made of brittle material which can fracture. Each gas burner extends through an opening in the plate-shaped body and extends above the upper surface thereof. A permanent-elastic connecting and sealing device is mounted between the form body and each gas burner. The connecting and sealing device includes a connecting and sealing element engaging fixedly and liquid tight to the peripheral region of the opening and to at least a connecting surface formed by the gas burner. The gas burner is supported by the form body and holding devices are mounted between the gas burner and the supporting frame. The holding devices become effective for each gas burner when there is a fracture of the form body and therefore a loss of its carrying capabilities. The holding devices permit a limited movement and guarantee against rotation for each of the gas burners.

This burner arrangement is very complex to assemble. Furthermore, connections held with adhesive provide a mechanically rigid connection but are disadvantageous for recycling or during assembly, for example, because of the time needed for the silicon adhesive to dry as well as for repairs during a service call. Furthermore, connections utilizing adhesives are not permanently stable with respect to temperature. The gas burners are supported by the plate-shaped form body and exhibit limited movability only with respect to the carrier frame and the housing parts. For this reason, no optimal mechanical decoupling between the gas burner and the plate-shaped form body is provided.

The state of the art described above is especially disadvantageous in that a special configuration of the burner is always necessary, for example, the sealing surface between the burner and the collar must be correspondingly configured. Also, all known solutions have the disadvantage that the cooktop must be manufactured only utilizing complex overhead assembly. This increases production costs considerably.

Because of the overhead assembly, service is very complex and requires that the apparatus be disassembled from the counter top and the disassembly of the entire apparatus insofar as this is even possible because of the use of adhesive. This time-intensive maintenance in the case of service likewise introduces very high costs.

SUMMARY OF THE INVENTION

It is an object of the invention to so configure an arrangement of an atmospheric gas burner in a gas cooktop panel that a simple and cost-effective assembly and disassembly is possible especially of the gas burners while considering the special requirements that the panel (made of glass ceramic, glass or glass ceramic) imposes on the construction of a cooktop apparatus.

The arrangement of the invention should provide a simple assembly during manufacture and a simple disassembly in the case of a service call. It is especially important that the apparatus can be assembled without an overhead assembly and that, during a service call, the apparatus can be serviced without disassembly of the cooktop from the counter top.

This area of the object of the invention is especially important for the economic consideration of this kind of a solution. This is so, because with a simple assembly from above, the production costs are considerably reduced. And, on the other hand, the time needed for maintenance work in the case of a service call is significantly reduced.

It is another object of the invention to be able to also utilize burners having different geometries as available in the marketplace with cooktop plates made of glass, ceramic or glass ceramic.

The cooktop apparatus of the invention includes: an atmospheric gas burner; a frame; a cooktop panel seated in the frame and being made of glass ceramic, glass or ceramic; the cooktop panel having a cutout formed therein for accommodating the gas burner in the cooktop panel; the cooktop panel further having an upper side and a lower side; a component assembly for holding the gas burner in the cooktop panel and the component assembly including: a collar annularly overlapping a portion of the panel in the region of the cutout; the collar having an inner region defining an edge which, in turn, defines a first abutment for engaging the gas burner; a resilient metal element attached to the gas burner and extending outwardly from the gas burner to engage the panel on the lower side thereof; the lower side of the panel defining a second abutment against which the resilient metal element applies a force F to hold the gas burner on the panel via the collar and the resilient metal element; and, a seal sandwiched and clamped between the collar and the panel thereby preventing any spillage from reaching the frame through the cutout.

In the above arrangement, the part of the construction which engages as a collar over the cooktop panel and the part of the construction which engages from below both hold or clamp precisely opposite each other. In this case, no bending stresses are introduced into the cooktop panel via the attachment of the burners; instead, only pressure stresses are so introduced which leads to a considerable reduction with respect to the danger of fracture.

A part of the assembly engages the cooktop panel as a collar in the form of an annular disc or frame. In a preferred embodiment, this collar defines an abutment for the gas burner and the collar is releasably connected to the gas burner, preferably with threaded fasteners.

The connection then takes place via a flange-shaped projection which is formed on the burner. This projection has a smaller diameter than the opening in the cooktop panel but a larger diameter than the diameter of the inner region of the collar of the part of the assembly engaging from above.

The attachment of the resilient metal element of the part of the assembly which engages under the panel is directly at the lower end of the gas burner in a preferred embodiment of the invention.

In a further preferred embodiment, the resilient metal element of the above-mentioned part is attached between the collar connected to the flange-like projection of the burner.

In a further embodiment, the resilient metal element is attached to a transverse bracket which is connected form-tight to the frame of the cooktop apparatus. The transverse bracket is connected into lugs or brackets which are provided on the frame of the cooktop apparatus. The collar of the over-engaging part is releasably attached to the transverse bracket in order to provide a tight seat to the arrangement. This can be advantageously achieved with an attachment angle bracket held by threaded fasteners.

For specific gas burners, it has been shown advantageous that the burner is positioned and pressed tight via a further resilient element and/or via guide bolts. These guide bolts are supported on the base of the cooktop and are held from below against the collar of the part of the construction which engages over the panel.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
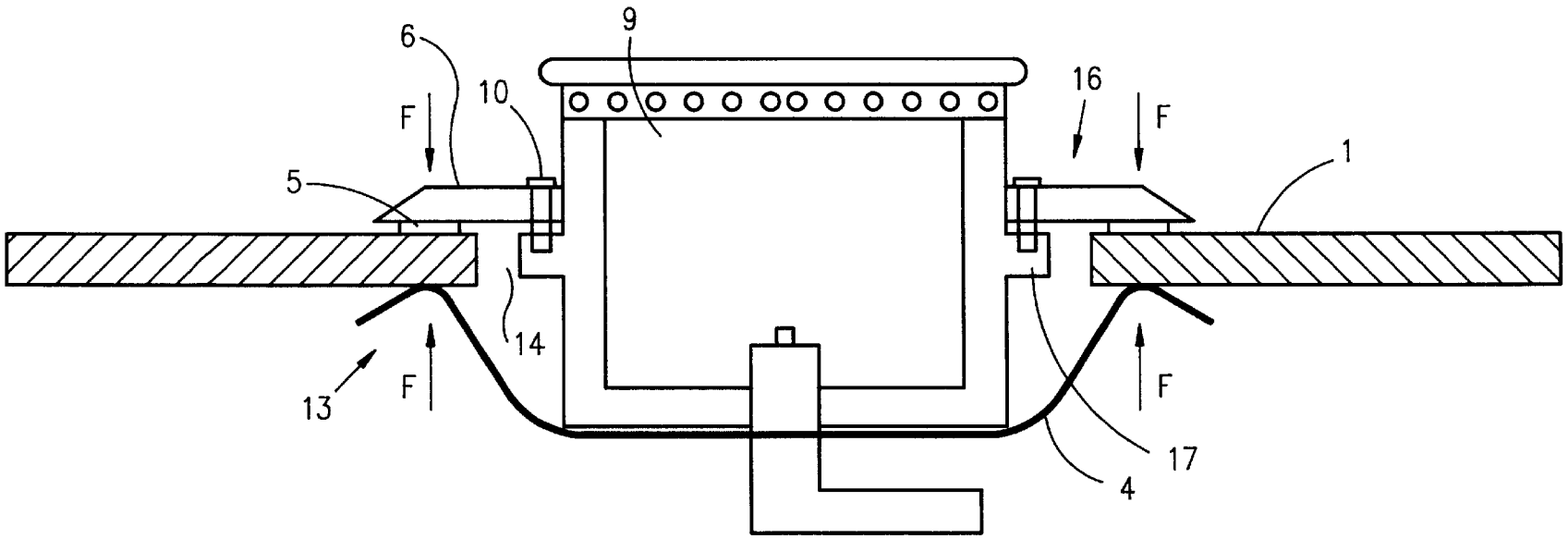
FIG. 1 shows an embodiment of a pot-shaped burner connected to a cooktop panel made of glass or glass ceramic.

FIG. 1 shows the arrangement of a gas burner 9 in the cooktop panel 1 made of glass or glass ceramic. The gas burner 9 has the special form of a so-called pot burner.

The burner 9 and the collar 6 are connected to each other utilizing threaded fasteners 10 as joining elements. A spring 4 is attached to the lower side of the gas burner 9, for example, with threaded fasteners. The spring 4 develops a force F in a direction away from the panel 1 because of the connection of the burner 9 and collar 6. The burner 9 with the sealing disc 5 is pressed toward the panel 1 in opposition to this spring force F.

The system defined by the gas burner and the panel is mechanically decoupled from the frame of the cooktop apparatus 3. In the case of a blow to the panel 1 or to the gas burner 9, no lever forces develop as consequence thereof which could be caused by rigidly mounted components of the cooktop apparatus, that is, components located on the lower side of the panel 1 or at a very slight distance from the panel. These forces can lead to a fracture when the maximum material loading is exceeded.

A seal 5 is provided between the collar 6 and the panel 1. The seal 5 is pressed tight by this force-tight connection of the burner 9, collar 6 and panel 1. In this way, a penetration of liquid into the interior of the cooktop apparatus 3 is reliably prevented.

An especially advantageous configuration is provided with the arrangement of the force-introduction points of the spring 4 and the collar 6 along one axis. This is so because, in this case, no bending stresses are introduced into the panel 1 via the attachment of the burner 9; instead, only pressure stresses are introduced which leads to a considerable reduction of the danger of fracture of the panel 1. Adequate overlap is likewise provided by the collar 6 to protect the edge of the bore hole 14.

With this arrangement, an assembly from below is not required because all components can be inserted from above into the panel 1 and mounted. This simplifies the first assembly as well as the assembly needed in the case of a service call to effect a repair to the cooktop apparatus.

Figure 2:
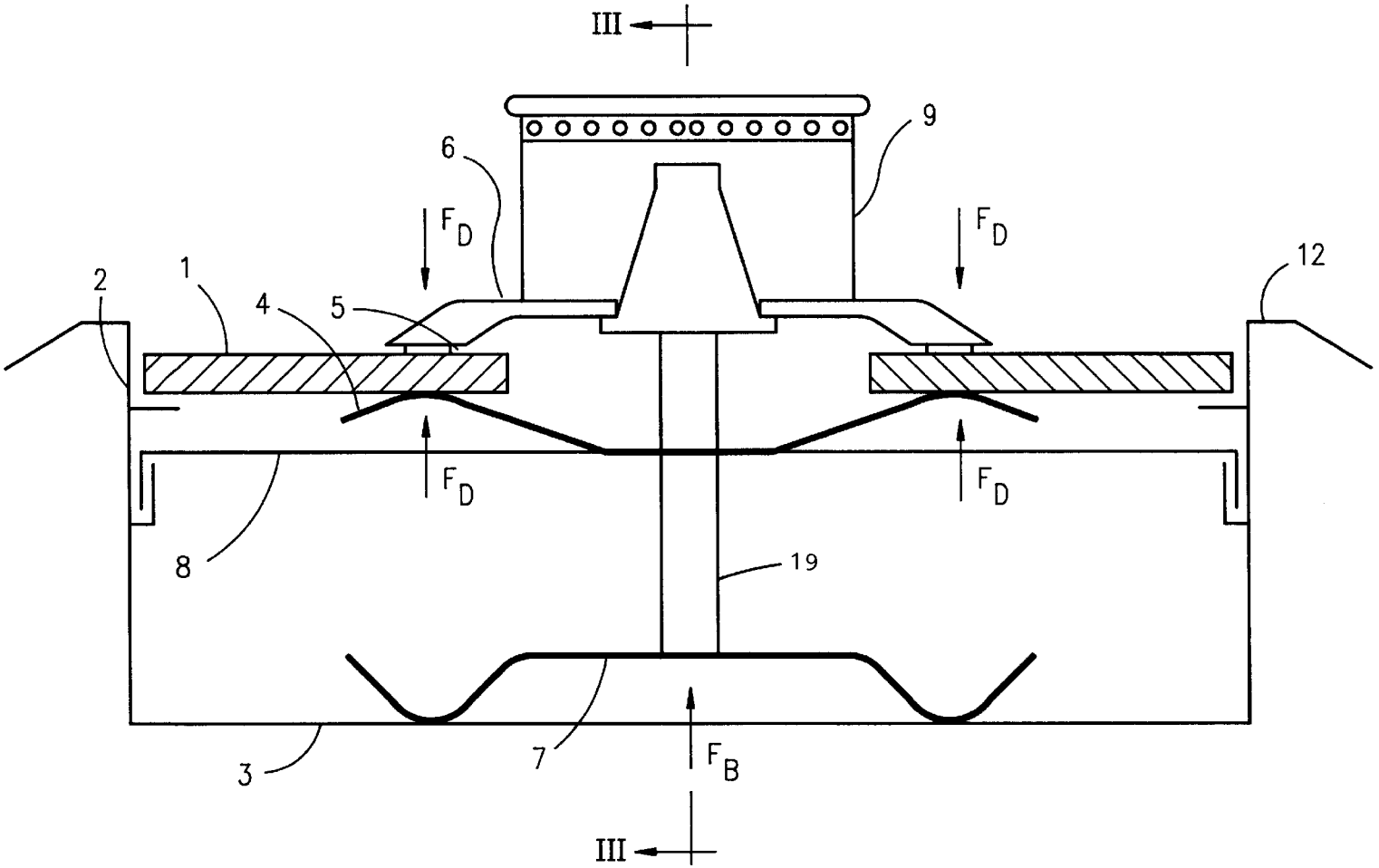
FIG. 2 is a side elevation view of another gas burner mounted in a cooktop panel made of glass or glass ceramic.
Figure 3:
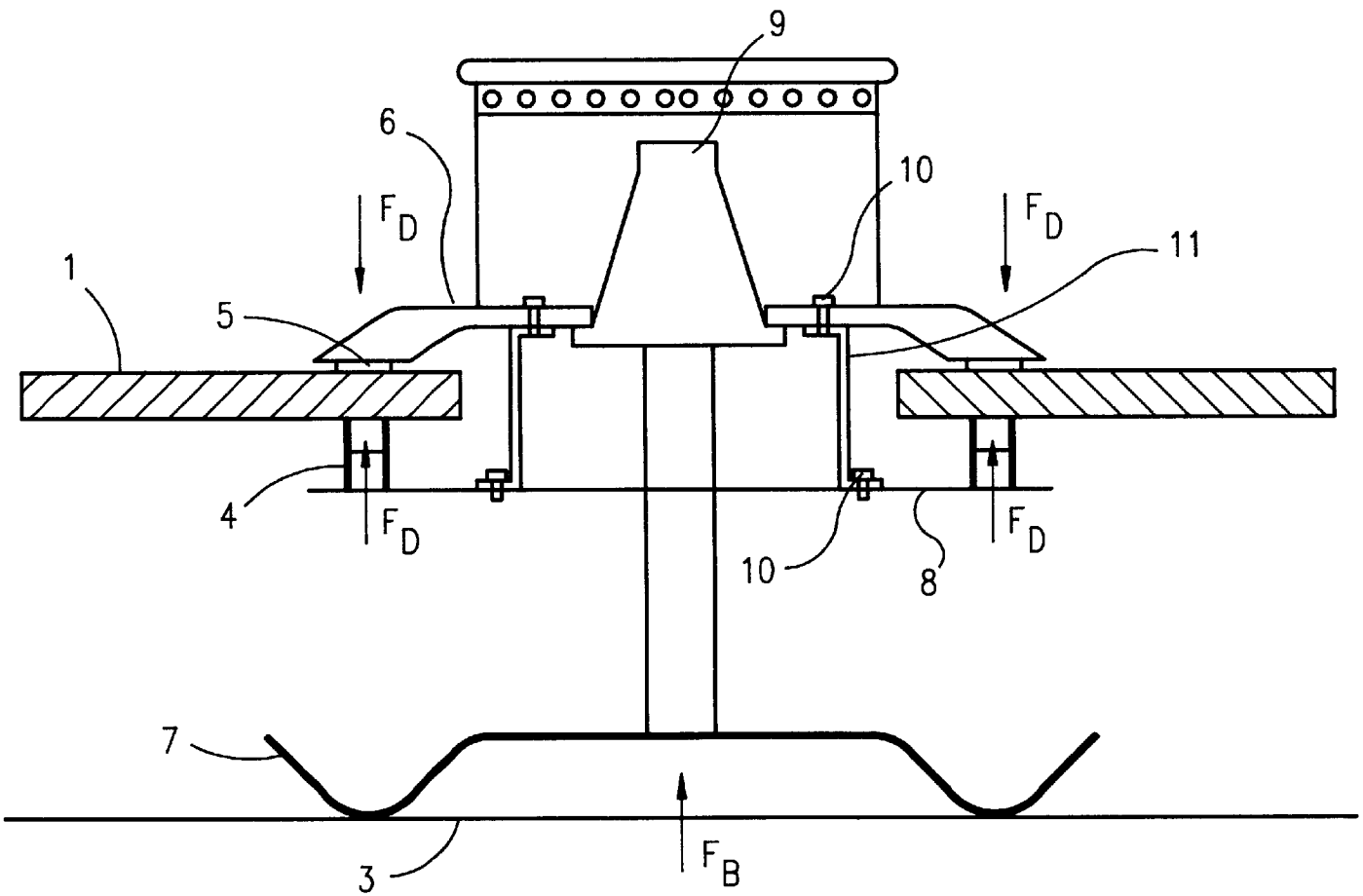
FIG. 3 is a side elevation view of the assembly of FIG. 2 taken along line III—III of FIG. 2.
Figure 4:
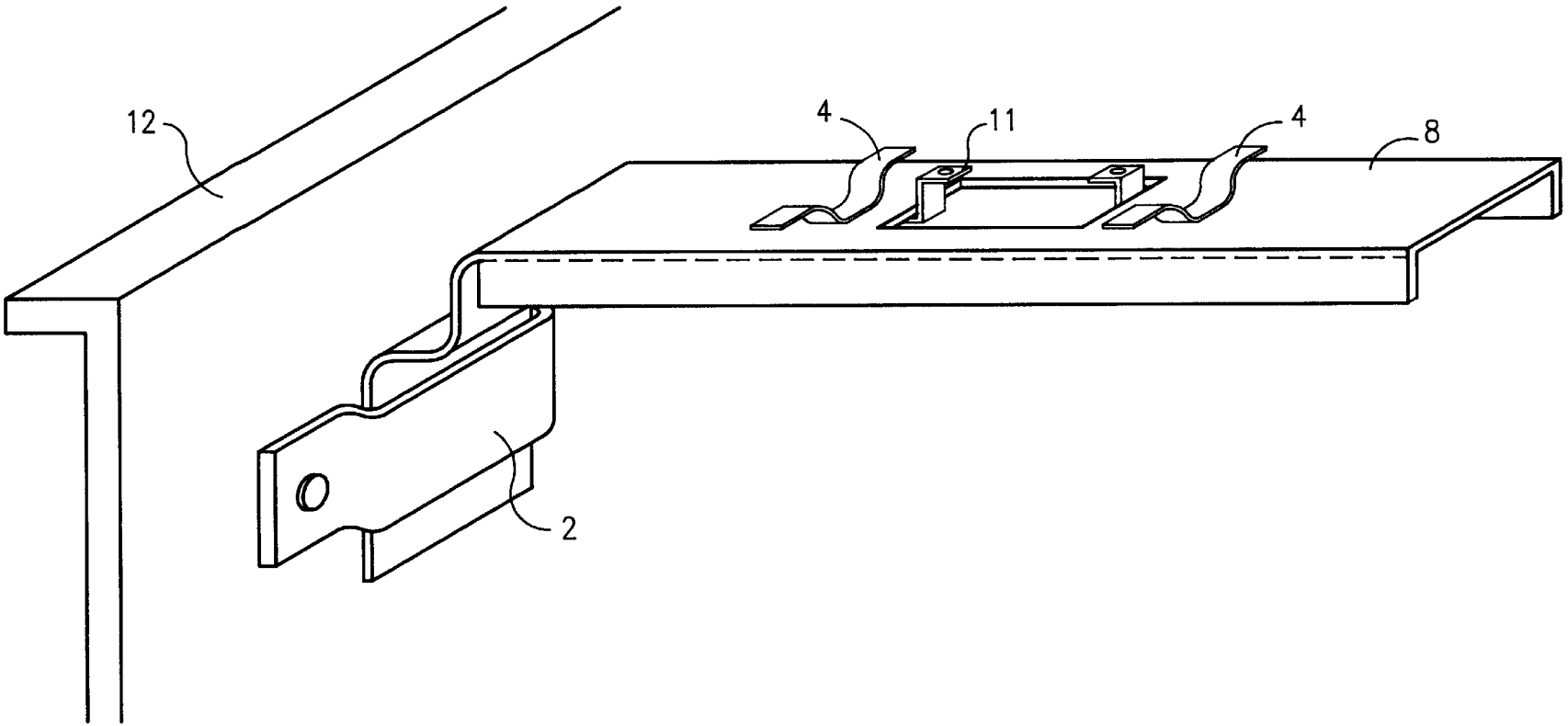
FIG. 4 is a detail perspective view of a portion of the assembly shown in FIGS. 2 and 3 showing a transverse member having a cutout for accommodating the gas supply pipe.

Another arrangement of the gas burner in the panel 1 is shown in FIGS. 2, 3 and 4. The transverse member 8 is the central component of this arrangement and it is inserted into and held by brackets 2 in the frame 12 of the cooktop apparatus. The collar 6 is attached to the transverse member 8 via angle brackets 11. Transverse member 8, attachment angle 11 and collar 6 are releasably attached to each other utilizing threaded fasteners 10.

A requirement of the arrangement of a gas burner 9 on a panel 1 made of glass ceramic is the prevention of the penetration of liquids and spillage into the interior of the cooktop apparatus. For this purpose, a resilient element 4 is mounted on the transverse member 8. The resilient element 4 is pressed against the lower side of the panel 1 because the collar 6 is held against the transverse member 8 utilizing threaded fasteners. The collar 6, seal 5, panel 1 and transverse member 8 are pressed together by the force $F_D$. The seal 5 is pressed tightly between the collar 6 and the panel 1 and reliably prevents the penetration of spillage into the cooktop apparatus.

The burner 9 is pressed against the collar 6 via a further resilient element 7 attached to the gas feed pipe 19. This resilient mounting of the burner 9 ensures a mechanical decoupling of the gas burner/panel system. In the event of a blow to the panel 1 or to the burner 9, no lever forces can occur thereby which could be caused by rigidly mounted components of the cooktop apparatus 3 which lie against the lower side of the panel 1 or are only at a minimal spacing therefrom. These forces could lead to a fracture of the panel when the maximum loading of the material thereof is exceeded.

The edge of bore hole opening 14 is likewise protected by an adequate overlapping of the collar 6.

Here too, the overhead assembly of this arrangement is not required because all components can be seated and mounted from above in the cooking area. This simplifies the initial assembly as well as an assembly required during a service call in the case of a repair because releasing all connections can be done from above.

Figure 5:
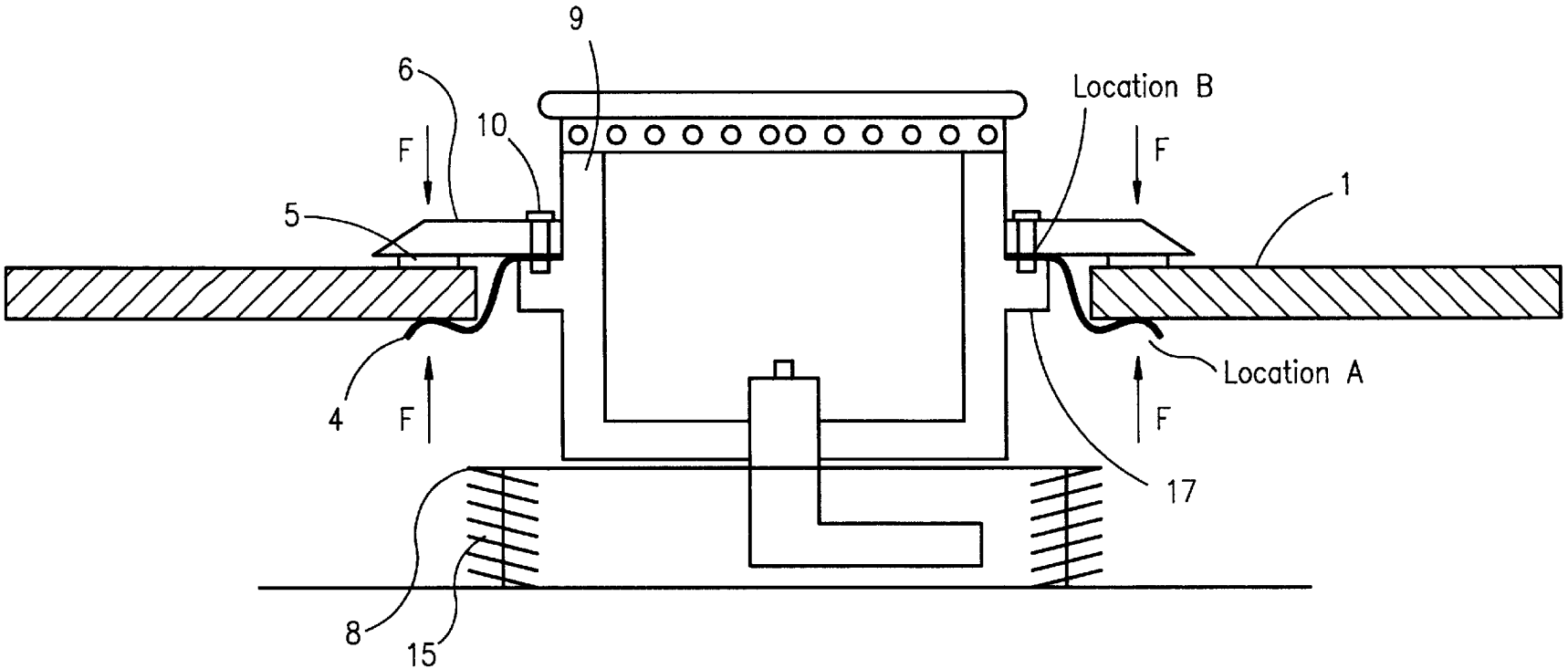
FIG. 5 is an arrangement of the gas burner and cooktop panel in accordance with another embodiment of the cooktop apparatus of the invention; and, FIG. 6 shows still another embodiment of the gas burner mounted relative to the panel of the cooktop apparatus.

In FIG. 5, a further mounting arrangement of a gas burner 9 on a panel 1 is shown. The main element in this arrangement is a specially formed spring 4. The mounting of this spring 4 is at two peripherally extending contact locations: location A on the lower side of the panel 1 and location B on a peripherally extending projection 17 of the burner 9. At location B, the spring 4 is connected to the burner 9 and the collar 6 via a releasable threaded-fastener connection 10. A spring tension in the direction of the panel 1 is developed because of the connection of these components. The introduced force F lies on one influence line with seal 5 and the collar 6. On the one hand, this arrangement prevents the occurrence of bending stresses in the panel 1 and thereby reduces the risk of fracture of the panel made of glass, ceramic or glass ceramic. On the other hand, the arrangement ensures that the seal 5 is pressed against the panel 1. By pressing the seal 5, the penetration of spillage into the interior of the cooktop apparatus is reliably prevented.

This embodiment likewise affords the advantage that the system "gas burner/glass ceramic" is decoupled mechanically from the cooktop frame. In the case of a blow to the panel 1 or to the burner 9, no lever forces can therefore develop which could be attributed to the rigidly mounted components of the cooktop apparatus 3 and which lie directly against or at a slight spacing to the lower side of the panel 1.

The spring 4 can be configured as a closed or continuous spring element or as a segmented spring.

The burner 9 is attached to a transverse member 8 to facilitate assembly. The transverse member 8 is supported via helical springs 15. With this assembly arrangement, the burner 9 is lifted and centered. The connection of the components at attachment location B utilizing threaded fasteners is thereby facilitated.

Figure 6:
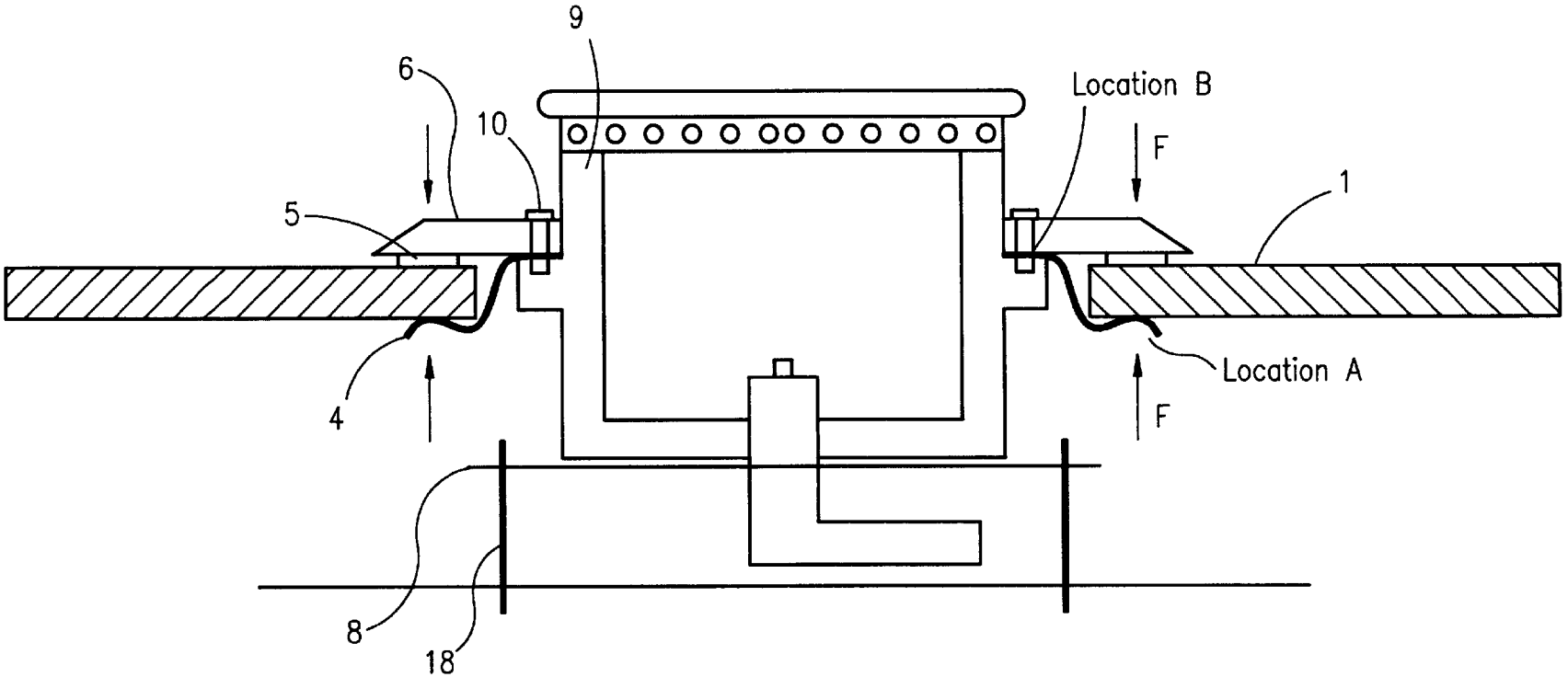

In a further preferred embodiment shown in FIG. 6, the helical spring 15 is replaced by guide bolts 18. This simple form of the assembly device ensures a centering of the burner 9 and thereby facilitates connecting the components at location B utilizing threaded fasteners.

This arrangement of the gas burner 9 on a panel 1 is characterized by an assembly from above and requires no overhead assembly. This simplifies the assembly during manufacture as well as maintenance work in the case of a service call because the connections can be released from above.

It is understood that the foregoing description is that of the preferred embodiments of the invention and that various changes and modifications may be made thereto without departing from the spirit and scope of the invention as defined in the appended claims.

What is claimed is:

1. A cooktop apparatus comprising:

an atmospheric gas burner;

a frame;

a cooktop panel seated in said frame and being made of glass ceramic, glass or ceramic;

said cooktop panel having a cutout formed therein for accommodating said gas burner in said cooktop panel;

said cooktop panel further having an upper side and a lower side;

a component assembly for holding said gas burner in said cooktop panel and said component assembly including:

a collar annularly overlapping a portion of said panel in the region of said cutout;

said collar having an inner region defining an edge which, in turn, defines a first abutment for engaging said gas burner;

a resilient metal element attached to said gas burner and extending outwardly from said gas burner to engage said panel on said lower side thereof;

said lower side of said panel defining a second abutment against which said resilient metal element applies a force F to hold said gas burner on said panel via said collar and said resilient metal element; and, a seal sandwiched and clamped between said collar and said panel thereby preventing any spillage from reaching said frame through said cutout.

2. The cooktop apparatus of claim 1, said collar and said resilient metal element both contacting said panel at mutually opposite lying locations.

3. The cooktop apparatus of claim 1, further comprising means for releasably fastening said collar to said gas burner.

4. The cooktop apparatus of claim 3, said means comprising threaded fasteners for releasably connecting said collar to said gas burner.

5. The cooktop apparatus of claim 3, said means comprising: a flange-like projection formed on said gas burner; and, fastener means for releasably attaching said collar to said flange-like projection.

6. The cooktop apparatus of claim 5, said cutout having a diameter; and, said flange-like projection having a diameter less than said diameter of said cutout.

7. The cooktop apparatus of claim 6, said inner region of said collar defining an opening having a diameter; and, said flange-like projection of said gas burner having a diameter greater than said diameter of said opening of said inner region of said collar.

8. The cooktop apparatus of claim 1, said gas burner having a lower end; and, said resilient metal element being attached to said lower end.

9. The cooktop apparatus of claim 5, said collar and said flange-like projection conjointly defining an interface; and, said resilient metal element being attached to said gas burner at said interface.

10. The cooktop apparatus of claim 8, said resilient metal element having a plate-like configuration defining a circular contact surface in contact engagement with said lower side of said panel.

11. The cooktop apparatus of claim 8, said resilient metal element having a strip-like configuration defining two surface regions extending over the width of said strip-like configuration; and, said surface regions being in contact engagement with said lower side of said panel.

12. A cooktop apparatus comprising:

an atmospheric gas burner;

a frame;

a cooktop panel seated in said frame and being made of glass ceramic, glass or ceramic;

said cooktop panel having a cutout formed therein for accommodating said gas burner in said cooktop panel;

said cooktop panel further having an upper side and a lower side;

a component assembly for holding said gas burner in said cooktop panel and said component assembly including:

a collar annularly overlapping a portion of said panel in the region of said cutout;

said collar having an inner region defining an edge which, in turn, defines a first abutment for engaging said gas burner;

a resilient metal element disposed below said panel to engage said panel on said lower side thereof;

means for connecting said resilient metal element to said gas burner and to said frame;

said lower side of said panel defining a second abutment against which said resilient metal element applies a force F to hold said gas burner on said panel via said collar and said resilient metal element; and, a seal sandwiched and clamped between said collar and said panel thereby preventing any spillage from reaching said frame through said cutout.

13. A cooktop apparatus comprising:

an atmospheric gas burner;

a frame;

a cooktop panel seated in said frame and being made of glass ceramic, glass or ceramic;

said cooktop panel having a cutout formed therein for accommodating said gas burner in said cooktop panel;

said cooktop panel further having an upper side and a lower side;

a component assembly for holding said gas burner in said cooktop panel and said component assembly including:

a collar annularly overlapping a portion of said panel in the region of said cutout;

said collar having an inner region defining an edge which, in turn, defines a first abutment for engaging said gas burner;

a first resilient strip-shaped metal element disposed below said panel to engage said panel on said lower side thereof;

a second resilient strip-shaped element disposed below said panel to also engage said panel on said lower side thereof;

means for connecting said first and second resilient strip-shaped metal elements to said collar;

said lower side of said panel defining a second abutment against which said first and second resilient strip-shaped metal elements apply a force F to hold said gas burner on said panel via said collar and said resilient metal element; and, a seal sandwiched and clamped between said collar and said panel thereby preventing any spillage from reaching said frame through said cutout.

14. The cooktop apparatus of claim 13, said first and second strip-shaped metal elements being disposed in a symmetrical arrangement.

15. The cooktop apparatus of claim 12, said connecting means including: a transverse member mounted in said frame and said resilient metal element being connected to said transverse member; and, attachment means for connecting said collar to said transverse member.

16. The cooktop apparatus of claim 15, wherein at least one of the following is formed from said transverse member: said resilient metal element and said attachment means.

17. The cooktop apparatus of claim 15, said frame having mounting brackets; and, said transverse member being mounted in said mounting brackets.

18. The cooktop apparatus of claim 15, said transverse member being resiliently movable in a vertical direction relative to said frame.

19. The cooktop apparatus of claim 15, further comprising means for indirectly releasably connecting said collar to said transverse member.

20. The cooktop apparatus of claim 19, said attachment means comprising: angle brackets for connecting said collar to said transverse member; and, fastener means for connecting said brackets to said collar and to said transverse member.

21. The cooktop apparatus of claim 1, said frame having a base and said cooktop apparatus further comprising at least one of the following: an additional resilient metal element interposed between said gas burner and said base; and, guide bolts mounted between said gas burner and said base.

* * * * *